United States Patent [19]

Paterson et al.

[11] 4,047,271

[45] Sept. 13, 1977

[54] METHOD FOR SPACE DYEING YARN

[75] Inventors: James G. T. Paterson; Charles W. Watkins, both of Chattanooga, Tenn.; Grover G. Duckworth, Jr., Dalton, Ga.

[73] Assignee: Interdye Technology Corporation, Dalton, Ga.

[21] Appl. No.: 646,352

[22] Filed: Jan. 2, 1976

[51] Int. Cl.[2] ..... D06B 1/14; D06B 11/00

[52] U.S. Cl. ..... 28/220; 8/149; 8/149.1; 8/151.2; 68/5 D; 68/203; 118/234; 118/DIG. 20; 118/DIG. 21

[58] Field of Search ..... 8/149, 149.1, 149.3, 8/151.2; 68/5 D, 5 E, 203, 204, 202; 28/72.16, 75 WT; 118/DIG. 20, DIG. 21, 234; 101/172;

[56] References Cited

U.S. PATENT DOCUMENTS

| | | | |
|---|---|---|---|
| 1,512,166 | 10/1924 | Gordon et al. | 68/203 |
| 2,573,097 | 10/1951 | Epstein | 68/203 |
| 3,800,565 | 4/1974 | Worth et al. | 68/203 X |
| 3,803,880 | 4/1974 | Laing et al. | 68/202 X |
| 3,926,547 | 12/1975 | O'Mahony et al. | 28/75 WT X |

FOREIGN PATENT DOCUMENTS

| | | | |
|---|---|---|---|
| 39,313 | 10/1972 | Japan | 68/203 |

*Primary Examiner*—Philip R. Coe
*Attorney, Agent, or Firm*—Bell, Seltzer, Park & Gibson

[57] ABSTRACT

A method for space dyeing yarn wherein a rapidly advancing yarn is intermittently deflected into and out of a nip of a pair of rotating dye applicator rollers, such that those portions of the yarn which pass through the nip are subjected to a rapidly applied and substantial compressive force in the nature of a hammer-like impact in the nip, to cause the dye carried by the rollers to deeply penetrate into the yarn. In the illustrated embodiment, the yarn is advanced past a plurality of such pairs of dye applicator rollers, and an external pattern control acts to deflect the yarn into and out of the various nips in accordance with a predetermined program.

16 Claims, 12 Drawing Figures

53
50
7
76
74
79
38
77
72
73
30
40
35
56
45
48
32D
59
49
41
Y4
54
70
84
56
45
48
49
32C
Y3
54
70
84
7
6
6
56
45
48
32B
59
49
Y2
54
70
84
56
45
48
49
32A
59
84
Y1
54
70
38
41
40
35

METHOD FOR SPACE DYEING YARN

The present invention relates to a method for producing randomly or space dyed yarns suitable for use in fabricating multi-colored tufted carpets, or the like, and characterized by a high rate of production, substantially complete penetration of the dye into the yarn, and a high degree of pattern control.

There are several known processes for randomly printing a yarn for use in fabricating multi-colored fabrics. One common process is called the "knit de knit" process, and includes the steps of knitting the yarn into a knitted prefabric, applying stripes or other patterns of dye on the fabric by a roller printing operation, heat setting the dye, and then unraveling the fabric to produce a space dyed yarn. The heat setting operation tends to set permanent kinks or curls in the yarn due to the loops produced in knitting, and it is common to attempt to subsequently remove these kinks by various processes such as running the kinked yarn over a series of corners. A typical process of this type is further described in the U.S. Pat. to Whitaker et al, Nos. 3,012,303 and 3,102,322.

Even where attempts are made to remove as many of the kinks and curls as possible from "knit de knit" yarn, the resulting yarn nevertheless possesses a considerable amount of kinking, and such kinking is unsuitable in many applications such as where long shag or plush carpets are to be constructed from the yarn. Further, the attempts to remove the kinks tend to draw out the yarn, and thus a considerable portion of the bulk or covering ability of the yarn is lost. Another significant disadvantage of the "knit de knit" process is the fact that the conventional printing operation usually does not achieve a thorough penetration of the dye into the yarn, since the pressure exerted by the printing rollers is insufficient to insure that the dye will be forced fully into the yarn. Thus incomplete and non-uniform coloration often results.

Another commonly employed process for producing spaced dyed yarns involves passing a large number or warp of yarns in a parallel arrangement through a series of dye applicators that are charged with dyes of different colors. As the warp of yarns passes through the machine, predetermined portions are pressed into contact with selected applicators to achieve the desired space printing. The yarns are then steamed to fix the dye. A typical process of this type is disclosed in the U.S. Pat. to Farrer et al, No. 3,503,232.

While the warp printing operation achieves a straight, non-kinked yarn which is desirable for plush or shag type constructions, the fact that considerable stress is placed on the yarns during the printing and steaming operations results in a significant loss of bulk which usualy cannot be recovered. Also, since the dye printing operation operates under limited pressure conditions, deep penetration of the dye into the yarn is not achieved. Still further, the large number of warp yarns employed in the typical warp printing operation results in a high percentage of down time to fix broken ends, which in turn results in a low production efficiency.

It has also been proposed to space dye a running length of yarn by directing the yarn through the nip of printing rollers which have patterned lands and grooves on the outer periphery thereof, note for example the U.S. Pat. to Laing et al, No. 3,803,880. In this apparatus, the printing rollers apply dye to the yarn when the lands of the two rollers are aligned across the nip; otherwise, no dye is applied. However, pattern variation and control in the Laing apparatus is severely limited since the dye pattern applied to the yarn is dictated by the particular pattern configuration of the rollers. Thus in order to significantly vary the pattern, it is necessary to change the printing rollers. Also, pattern control and variation is further limited in that the colorband length which may be applied to the yarn is limited by the circumference of the rollers.

A further problem associated with many existing space dyeing processes resides in the fact that the various colors are applied in a regular pattern along the length of each yarn, and such that the colors on adjacent yarns in the resulting fabric tend to get into and out of phase in a regular sequence. This results in visible streaks or chevrons on the face of the fabric which materially detract from the appearance thereof.

Another problem associated with conventional space dyeing processes resides in the fact that the dye often moves or migrates along the yarn during the subsequent heat setting operation. Thus the interface between adjacent colorbands becomes blurred, which detracts from the appearance of the resulting product.

It is accordingly an object of the present invention to provide a process for applying dye to spaced apart portions of a yarn which is characterized by substantially complete penetration of the dye into the yarn.

It is a further object of the present invention to provide a process of the described type which is capable of responding to an external pattern program in applying the dyes to the yarn to thereby achieve a high degree of pattern variation and control.

It is another object of the present invention to provide a process of the described type and wherein substantially complete control and variation of the pattern of the applied dye is achievable so that visible streaks or chevrons on the face of the resulting fabric are substantially eliminated.

It is a more specific object of the present invention to provide a process of the described type wherein dyes of different colors may be selectively applied in a closely controlled predetermined pattern such that the various colorbands may be juxtaposed along the length of the yarn without significant overlap and without significant migration of the dye, to thereby achieve a sharp break at the interface between the colorbands.

It is still another object of the present invention to provide a process of the described type which is characterized by a high rate of production, and wherein the resulting yarn possesses a high degree of bulk, and is substantially free of kinks or curls.

It is also an object of the present invention to provide a space dyed yarn having a patterned multi-color appearance, and which is characterized by substantially complete penetration of the dye into the yarn and the absence of dye migration at the interface between the colors.

These and other objects and advantages of the present invention are achieved in accordance with the embodiments of the invention illustrated herein by the provision of a method which includes a pair of closely adjacent dye applicator rollers rotatably mounted on a frame and defining a nip therebetween, means for supplying dye to the peripheral surface of at least one of the rollers, means for advancing the yarn along a path of travel immediately adjacent the nip, and means for intermittently deflecting the advancing yarn into and out of the nip. The rollers are operatively rotated at a relatively high peripheral speed, and the yarn is advanced at a corresponding speed to facilitate the movement of the yarn into and out of the nip. Also, the rollers are preferably hard surfaced and resiliently biased toward each other, such that those portions of the yarn which pass through the nip are subjected to a rapid rate of increase of compressive force in the nature of a sudden hammer-like "impact" in tha nip which serves to force the dye carried by the rollers deeply into the body of the yarn, thereby resulting in substantially complete penetration of the dye into the yarn.

In the preferred embodiment, the apparatus comprises a plurality of the pairs of rollers serially arranged on a frame to define a plurality of printing stations, and means for independently supplying dye to the peripheral surfaces of each pair such that each printing station may apply a different color. Also, the deflection of the yarn is rapid both into and out of the nip, and the deflection is independently controlled at each printing station by an external pattern program which is coordinated with the speed of the advancing yarn such that the dyes may be applied in a closely controlled predetermined pattern with the colorbands being juxtaposed without significant overlap and with a sharp break at the interface between the colorbands.

Some of the objects of the invention having been stated, other objects will appear as the description proceeds, when taken in connection with the accompanying drawings, in which FIG. 1 is a schematic diagram of an overall process embodying the features of the present invention;

Figure 1:
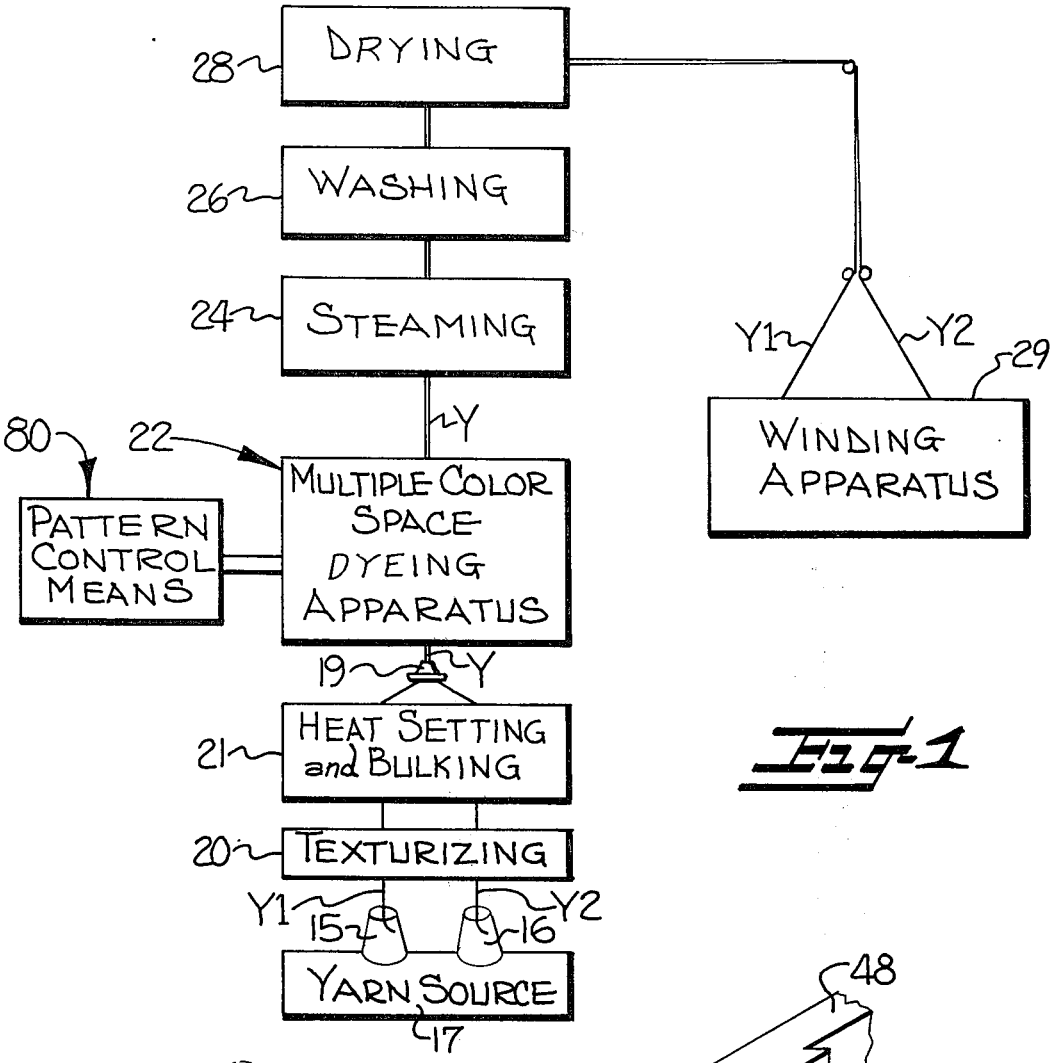

Referring more specifically to the drawings, FIG. 1 schematically represents one embodiment of an overall process employed in practicing the present invention, and wherein two yarn ends are processed simultaneously to increase the production capacity. More particularly, the two ends Y1, Y2, are withdrawn from the packages 15, 16 at the yarn source or creel 17, and the ends may be initially texturized in a conventional manner as indicated at 20, such as by means of a gear crimping operation or the like. Also, the yarn ends may be heat set and bulked at 21, or heat set alone, by means of hot air, steam or the like as known in the art. Alternatively, the texturizing, heat setting, and bulking steps may be performed independently as part of a discontinuous process.

The two yarn ends Y1, Y2 are next brought together through a ceramic eyelet 19 or the like to form a unitary strand hereinafter simply referred to as a yarn Y. The yarn Y is then passed through the printing apparatus 22 as further described below. From the printing apparatus, the advancing yarn is directed into a steamer 24 which is designed to set the dye, and which typically comprises a large winding reel (not shown) having a diameter of about 6 feet and wherein the yarn is helically wound so as to have a residence time of up to about five minutes therein. Preferably, the yarn is loosely wound on the reel to also permit the recovery of any bulk lost in the printing apparatus.

From the steamer 24, the advancing yarn Y is directed into a water trough 26 which may be about 6 feet long and wherein the yarn runs under the water to remove the excess dye, as well as any gum which may be present with the dye. Suitable extraction means, such as a nip formed between rubber rolls, may be employed at the downstream end of the washer to remove the excess water, and the advancing yarn is then directed into a drying chamber 28 which typically comprises a winding reel of a construction and size similar to that in the steamer. The yarn Y remains in the dryer for about five minutes, and hot air is applied to the yarn therein to evaporate any remaining water. Finally, the yarn is withdrawn from the dryer, separated into its component yarn ends, and wound into finished packages in a conventional winder as indicated at 29.

One embodiment of a printing apparatus 22 embodying the features of the present invention and adapted to apply three different colors to spaced apart portions of the yarn is illustrated in FIGS. 2–7. In particular, the apparatus 22 comprises a horizontally directed frame generally indicated at 30, and which mounts a total of three printing modules 31, 32, 33 serially arranged along the length of the frame. As will become apparent, the illustrated apparatus is adapted to concurrently process four advancing yarns Y1, Y2, Y3, and Y4, and each module comprises four printing stations arranged in parallel and indicated by the letters A, B, C, and D. Thus for example, the module 31 comprises the four printing stations 31A, 31B, 31C, and 31D. Also, the printing stations 31A, 32A, and 33A are serially arranged on the frame to process the yarn Y1, and similarly, the other sets of three aligned printing stations (having the same letter designation) process the yarns Y2, Y3, and Y4 respectively.

Figure 6:
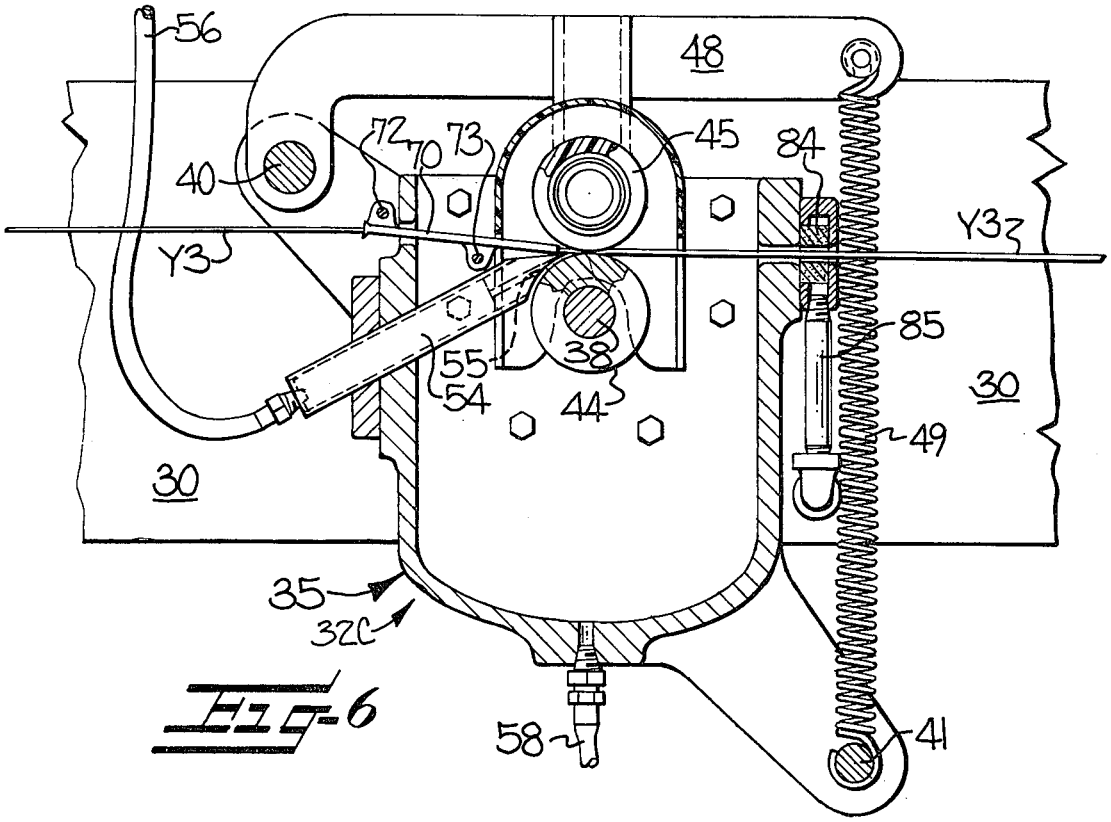
FIG. 6 is a sectional side view of one printing station in a module and taken substantially along the line 6—6 of FIG. 5.
Figure 7:
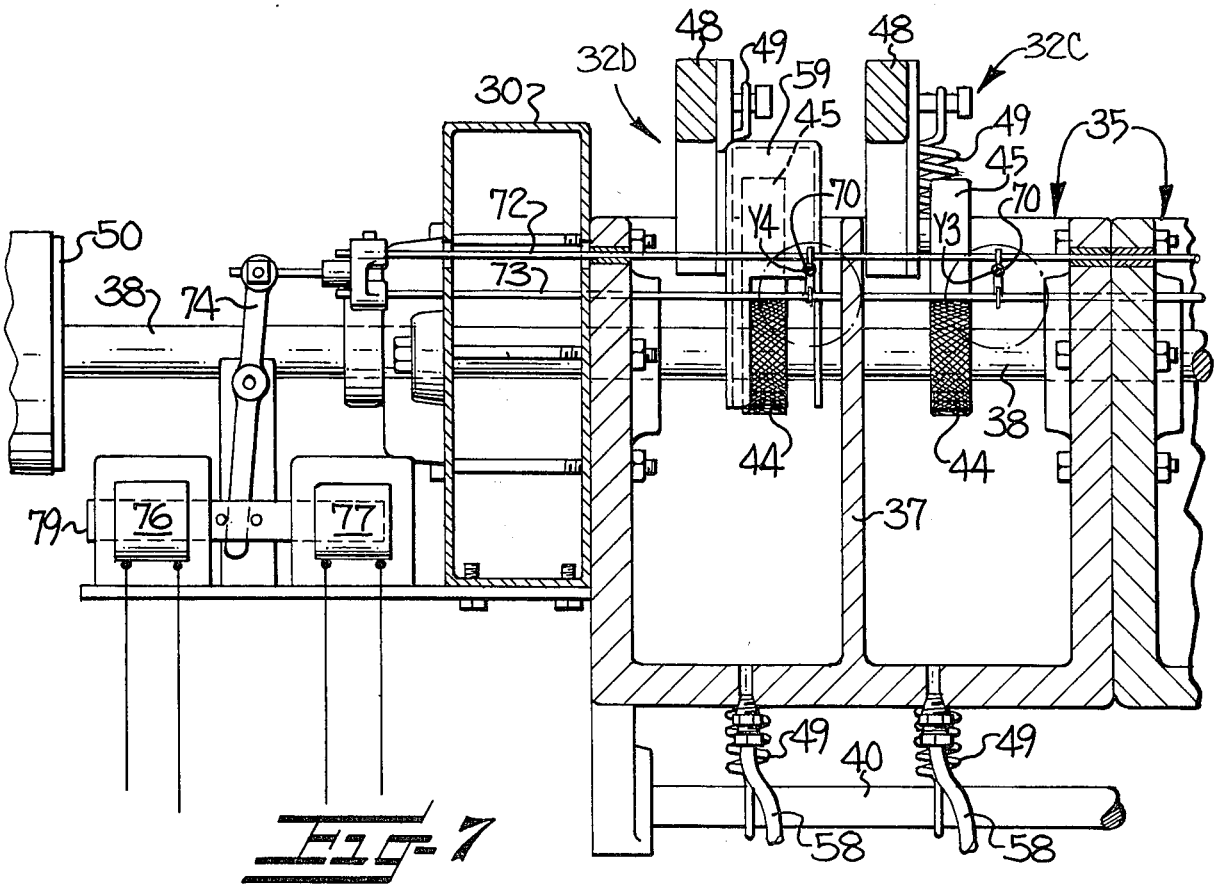
FIG. 7 is a sectional end view of the module and taken substantially along the line 7—7 of FIG. 5.
Figure 8:
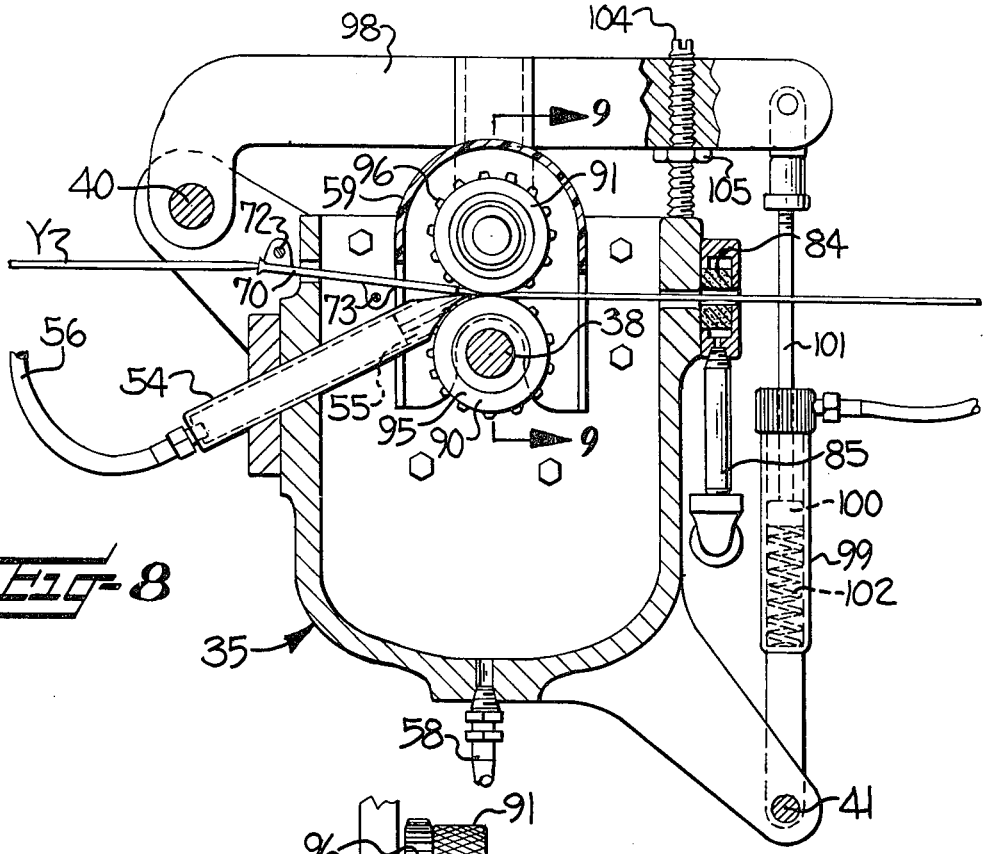
FIG. 8 is a view similar to FIG. 6 but illustrating a second embodiment of the printing station.
Figure 10:
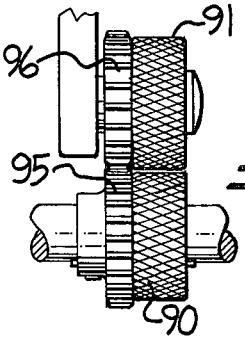
FIG. 10 is a fragmentary elevation view, on a reduced scale, of the printing rollers shown in FIGS. 8 and 9.
Figure 9:
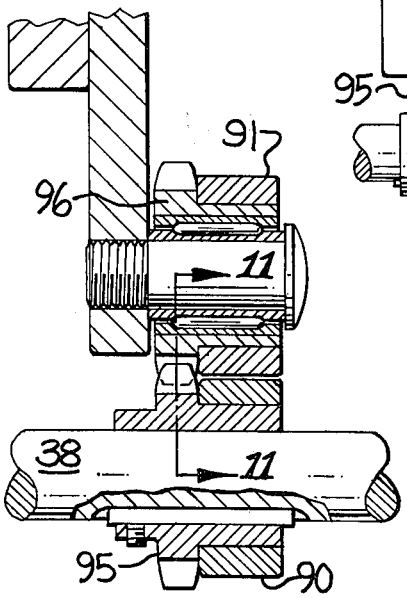
FIG. 9 is a sectional view of the printing rollers and taken substantially along the line 9—9 of FIG. 8.
Figure 11:
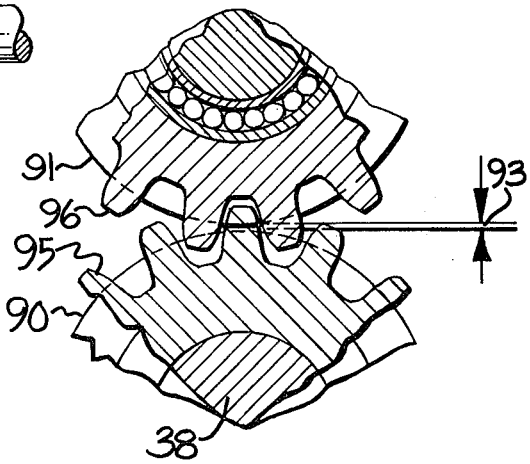
FIG. 11 is a fragmentary side elevation view of the rollers and gears shown in FIG. 8 and illustrating the gap between the printing rollers.

Each module comprises a U-shaped trough 35 fixedly mounted on the frame 30, the trough being fabricated from two interconnected segments of cast aluminum, stainless steel, or the like, and with each segment including a vertical interior wall 37 to thereby separately accommodate each of the four printing stations, note FIGS. 6 and 7. A horizontal shaft 38 extends transversely through each module and frame 30, and is rotatably mounted thereon for the purposes hereinafter set forth. Also, each module fixedly carries two other transverse rods 40 and 41 on the exterior thereof.

As best seen in FIG. 6, each printing station within each module comprises a pair of closely adjacent dye applicator or printing rollers 44, 45 which are rotatably mounted on the frame and define a nip therebetween. More particularly, the lower of each pair of rollers is mounted for rotation with the horizontal shaft 38, such that each of the four lower rollers 44 in a given module are concurrently rotated upon rotation of the shaft 38. The upper roller 45 of each printing station is rotatably carried by a lever arm 48, the arm being pivotally carried by the rod 40. The roller 45 is mounted at a medial position along the length of the lever arm 48, and is mounted for rotation about an axis which is parallel to the axis of the shaft 38. Also, the forward end of the arm 48 is resiliently biased downwardly by means of the spring 49 which is connected to the rod 41. By this arrangement, the rollers 44, 45 are permitted limited movement toward and away from each other, and the spring 49 serves to resiliently bias the rollers into rolling contact with each other.

In the illustrated embodiment, the lower roller 44 has a relatively small diameter, such as about 1½ inches, a width of about ½ inches, and it is fabricated from a relatively hard metal such as stainless steel. The peripheral surface of the roller 44 may be knurled to facilitate the application of a dye thereto and the entry of the yarn into the nip as hereinafter further explained. The upper roller 45 is of like size, but comprises a smooth outer periphery of plastic. Thus the peripheral surfaces of the upper and lower rollers are parallel to each other at the nip, and both of these surfaces are substantially smooth and non-interrupted. The plastic employed in the upper roller must be relatively hard to avoid undue wear with the stainless steel lower roller, and nylon has been found to be adequate for this purpose. In this regard, the use of a plastic of this type has been found to minimize the wear between the rollers, as compared for example with two stainless steel rollers.

Figures 3, 3A:
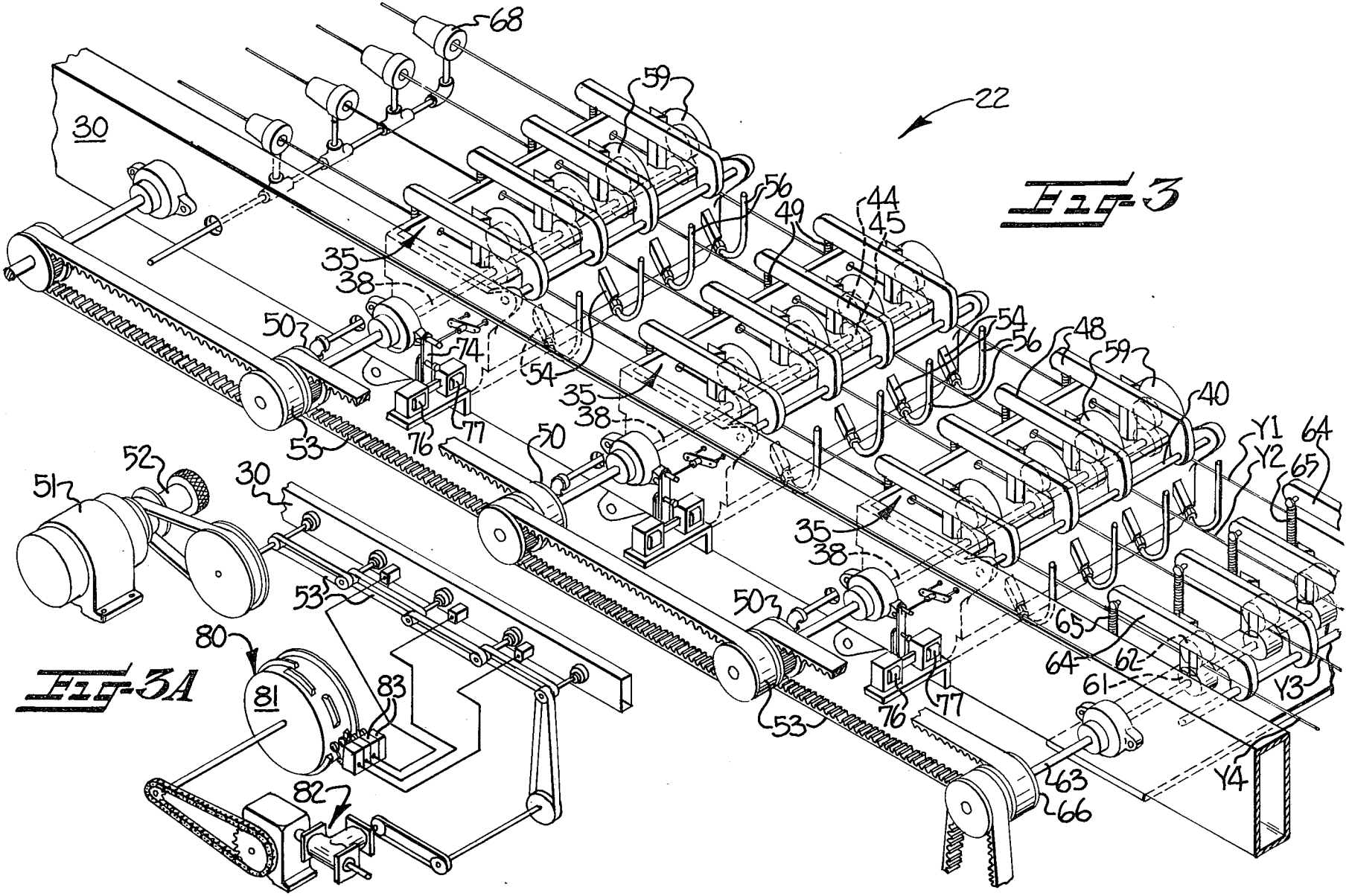
FIG. 3 is a perspective view of a printing apparatus which embodies the present invention and which is adapted to simultaneously process four separate yarns.
FIG. 3A is a schematic representation of the apparatus shown in FIG. 3, and further illustrating the power source and the pattern control system.
Figure 4:
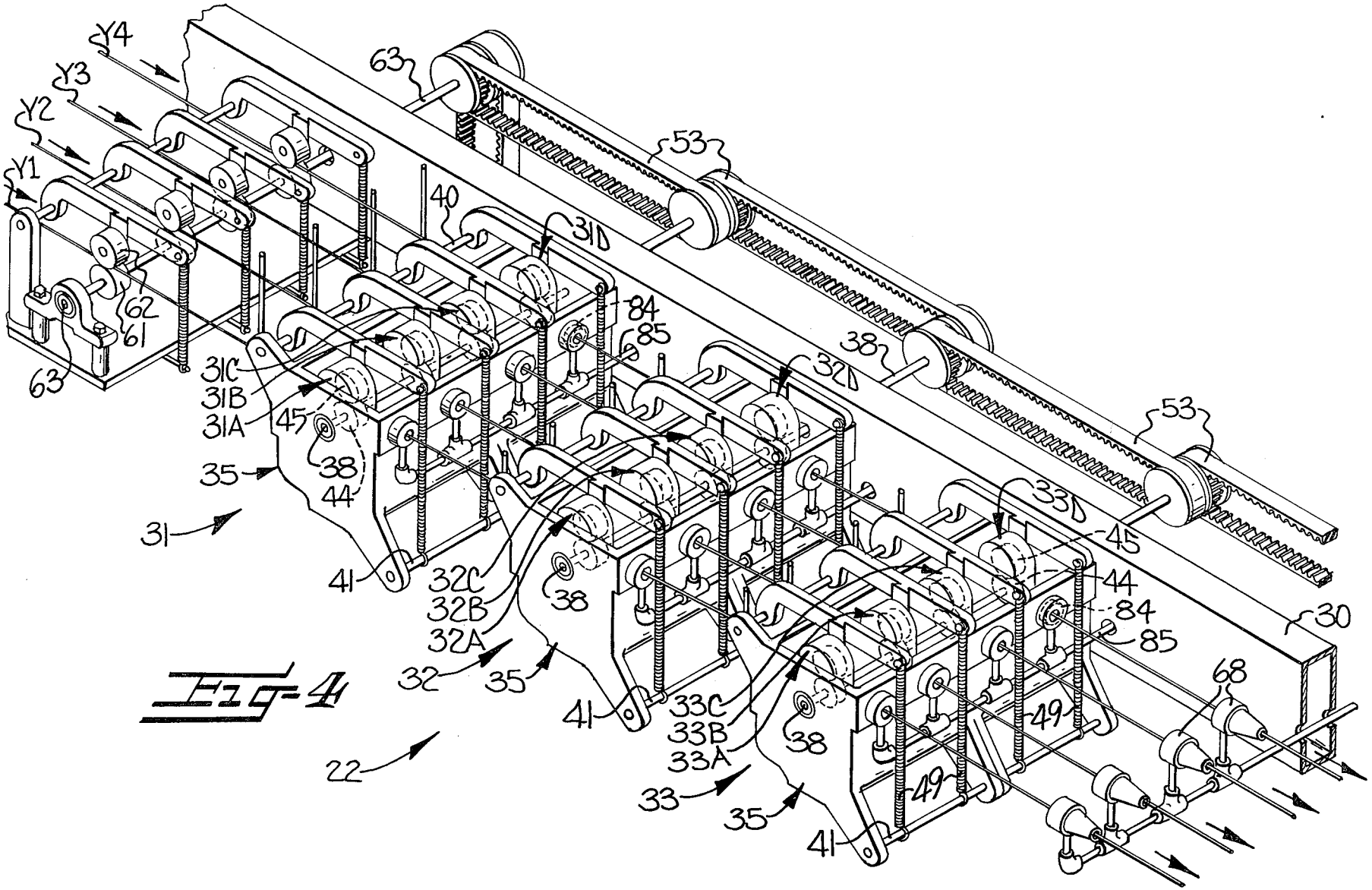
FIG. 4 is a view similar to FIG. 3 but viewing the apparatus from the opposite side.
Figure 5:
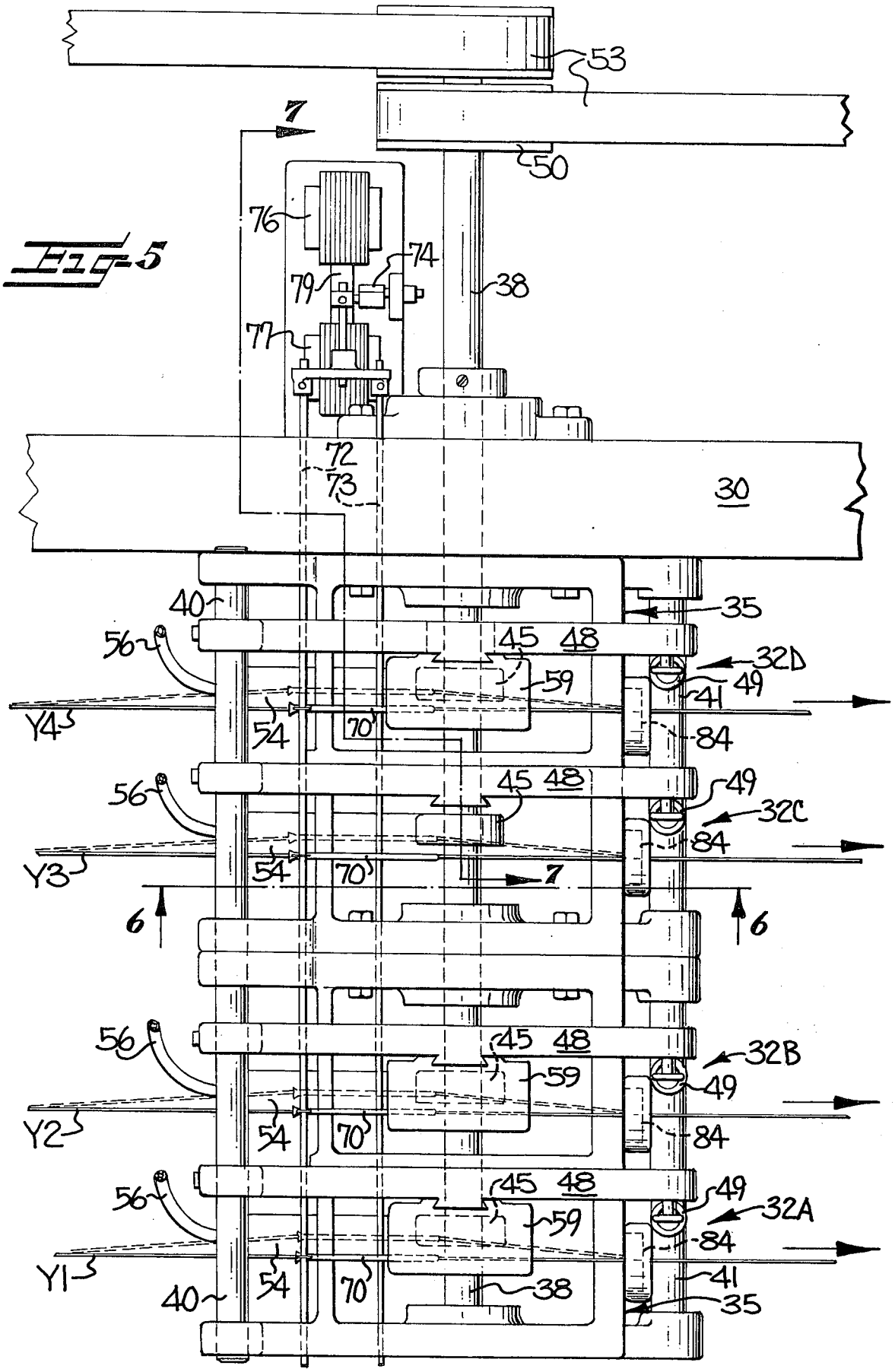
FIG. 5 is a fragmentary top plan view illustrating one of the printing modules of the apparatus shown in FIGS. 3 and 4.

The illustrated apparatus further comprises means for operatively rotating each of the pairs of rollers in each module at a corresponding peripheral speed. In this regard, each of the shafts 38 mounts a drive sprocket 50 at one end thereof, and the several sprockets are interconnected with the power source 51 by means of a number of non-slip drive belts 53 as best seen in FIGS. 3 and 3A. Thus each lower roller 44 is positively driven, and rotation is thereby imparted to the upper roller 45 by its contact with the associated lower roller across the nip. As illustrated, the power source 51 comprises a conventional electric motor having an adjustable speed control mechanism 52 whereby the speed of the apparatus may be readily co-ordinated with the speed of the steamer 24.

Figure 2:
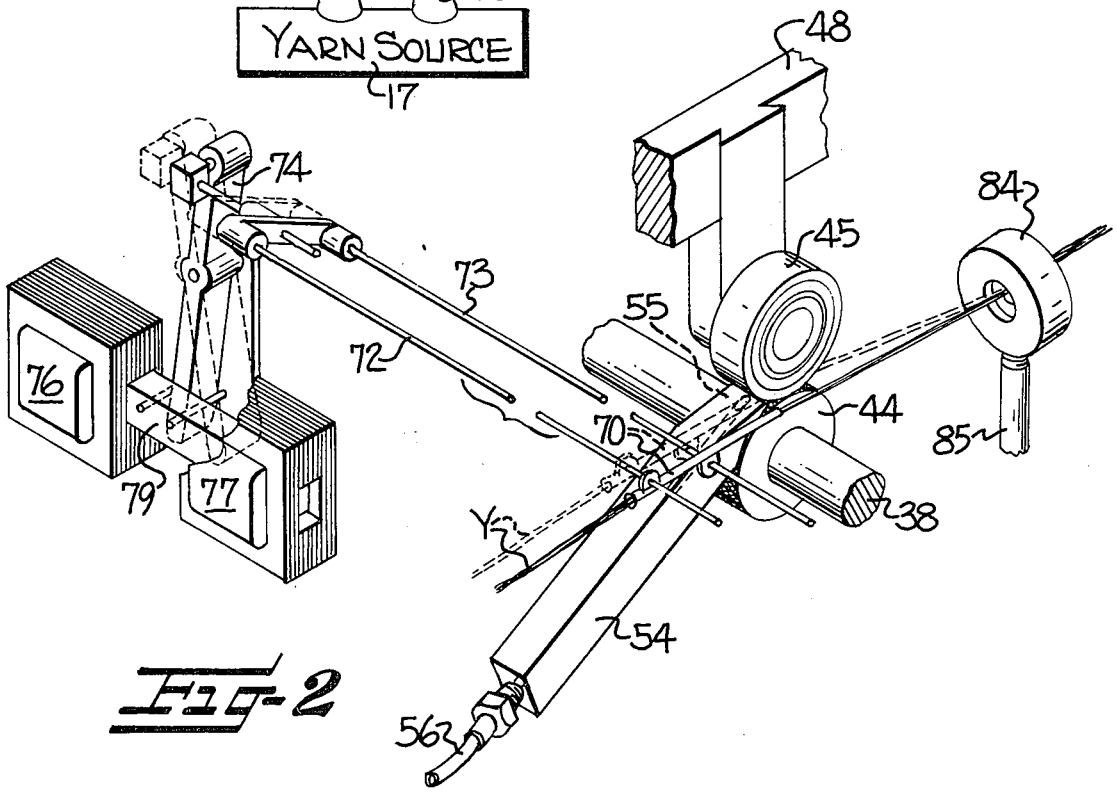
FIG. 2 is a fragmentary perspective view of a pair of printing rollers and yarn guide in accordance with the present invention.

A dye is independently supplied to the peripheral surface of the lower roller 44 of each pair of dye applicator rollers by means of a dye applicator tube 54, which is positioned immediately upstream of the nip. As best seen in FIGS. 2 and 6, the tube 54 is hollow and includes a plug 55 positioned in the forward end. A bore opening of about ⅛ inch diameter extends through the plug and opens at a point immediately above the lower roller 44. The opposite end of the tube 54 is in turn connected to a dye source (not shown) via the feed line 56, such that the dye may be fed into the tube 54 by a gravity feed system or the like, and a ribbon of dye is deposited on the surface of the rotating lower roller. Also, a flow control valve (not shown), such as a conventional rotameter, may be positioned in each feed line 56 to permit accurate control of the amount of dye deposited on the lower roller and thus the amount of dye pick-up.

The lowest point of each of the module segments includes a dye drain line 58 for returning the dye which falls from the rollers back to the dye source. In this regard, it will be understood that the dye supply arrangement for each pair of rollers may be connected to a separate dye source such that the color of the dye supplied to the various pairs of rollers may be individually selected. In addition, each module segment will be seen to further include a cover or splash guard 59 of inverted U-shape overlying the rollers to preclude splashing of the dye from one printing station to another.

The yarns Y1, Y2, Y3, and Y4 are advanced along parallel paths of travel, with the path of travel of each yarn being disposed immediately adjacent the nips of the three associated printing stations. Further, the yarns are advanced at a speed and direction which closely corresponds to the speed and direction of the periphery of the rollers at the nip.

The means for advancing the yarns in the manner described above includes four pairs of rollers 61, 62 disposed upstream of the printing stations, with each yarn being guided into the nip of the associated pair of rollers by a suitable eyelet 19 (FIG. 1) or the like. The advancing rollers 61, 62 correspond in size and structure to the printing rollers 44, 45, with the lower roller 61 being rotated with the shaft 63, and the upper roller 62 being mounted so as to be resiliently biased against the lower roller by means of the lever arm 64 and spring 65. Also, the shaft 63 is similar to the shafts 38, and includes a sprocket 66 which is operatively connected to the power source 51 such that the shaft 63 is rotated at a speed corresponding to that of the shafts 38 of the printing rollers. Thus the advancing rollers are rotated at a speed corresponding to that of the printing rollers.

In the illustrated embodiment, the advance of the yarns is further facilitated by means of an air nozzle 68 at the downsteam end of each of the aligned series of printing stations, the nozzles 68 being operatively connected to a source of pressurized air (not shown). In this regard, it is desirable to feed the yarns through the printing apparatus with as little tension as possible to avoid loss of bulk, and the illustrated advancing rollers and air nozzles contribute to this function. It will be understood however, that in many instances, the nozzles 68 may be omitted and the yarns may be advanced solely by the printing rollers, or by the printing rollers in combination with the winding reel in the steamer 24 which serves to draw the yarns through the printing apparatus, without undue loss of bulk.

In order to apply the dye to spaced apart portions of the advancing yarn to provide a patterned multi-color effect, means are provided for intermittently deflecting the advancing yarn into and out of the nip of each of the three aligned pairs of printing rollers. As hereinafter further described, those portions of the yarn which pass through the nip of any of the printing rollers are subjected to a rapidly applied and substantial compressive force in the nature of a hammer-like "impact" in the nip, which causes the dye carried by the rollers to deeply and thoroughly penetrate into the yarn.

The means for deflecting the yarn includes a tubular yarn guide 70 positioned immediately upstream of the nip of each printing station in each module, with the associated yarn being threaded therethrough. The guides 70 are carried between a pair of transverse control wires 72, 73 as best seen in FIGS. 2 and 7. A lever arm 74 is pivotally connected to the ends of the two wires 72, 73, and a pair of electrically operated solenoids 76, 77 are operatively connected to the lever arm 74 by means of a translatable core 79 as best seen in FIG. 7, such that be selectively actuating the solenoids 76, 77, the wires 72, 73 and four guides 70 carried thereon may be translated between a first position shown in solid lines in FIG. 2 wherein the yarn is laterally spaced from the nip, and a second position shown in dashed lines in FIG. 2 wherein the yarn is directly in front of the nip so as to be drawn therethrough. At the second position, the yarn is also in alignment with the opening at the forward end of the dye applicator tube 54 such that the yarn overlies the ribbon of dye on the lower roller 44. Typically, the length of the movement between the first and second positions is about ¼ inch, and the travel time in each direction is about 2 milliseconds. Each yarn guide 70 is directed downwardly slightly (note FIG. 6) as it approaches the nip to preclude the dye from running rearwardly therealong.

By the above arrangement, the yarn guides 70 of the four printing stations of each module are concurrently translated between the first and second positions. However, the three serially aligned printing stations associated with each yarn are independently and selectively controllable, such that a predetermined pattern is achievable. In this regard, each pair of solenoids 76, 77 is operatively controlled by a pattern control system generally illustrated at 80 in FIGS. 1 and 3A, and which in the illustrated embodiment comprises a control drum 81 driven by the power source 51 acting through the belts 53 and speed reduction system 82. As is well known in the art, the drum 81 has a peripheral surface with a separate channel for each of the pairs of solenoids, and a switch 83 follows each of the channels for activating each of the solenoids at a predetermined time and for a predetermined period. Thus the differently colored dyes of the aligned printing stations may be applied to the yarn in accordance with nearly any predetermined pattern. For example, the adjacent colorband lengths may be juxtaposed or meshed so as to achieve a substantially continuously dyed yarn with no significant overlap between the different colorbands. Alternatively, there may be a non-dyed segment between the different colorbands, or the adjacent colorbands may be overlapped a predetermined distance.

In order to remove any excess dye from the yarn after passing through a printing station, there is provided means for wiping the advancing yarn immediately downstream of each of the printing stations. In the illustrated embodiment, this wiping means comprises a porous metal disc 84 adapted to closely receive the yarn therethrough and serve as a yarn guide, and a compressed air line 85 operatively connected to the disc such that the air bleeds through the walls of the disc. Thus as the yarn passes through the disc, it is physically contacted by either the walls of the opening in the disc or the surrounding air to wipe the excess dye therefrom. Also, the air stream serves to clean the disc of the dye which has been wiped from the yarn by blowing the dye from the surface of the disc so that the removed dye does not contaminate the yarn.

To describe the overall operation of the printing apparatus of FIGS. 2–7 in more detail, the yarns Y1, Y2, Y3 and Y4 are initially threaded through the apparatus, and the dye supply system activated such that the dyes run from the tubes 54 onto each of the lower rollers 44. The power source 51 is then energized to rotate the shaft 63 and each of the shafts 38 and thereby operatively rotate each of the pairs of advancing rollers and pairs of printing rollers. Concurrently, the power source serves to activate the pattern control means 80, such that the pattern control is coordinated with the speed of the advancing rollers and printing rollers.

The yarns Y1, Y2, Y3, and Y4 are thereby advanced along parallel paths of travel, with each path being laterally spaced from the nip of each of the three associated pairs of printing rollers. Also, since the diameter and rotational speed of the advancing rollers are the same as the diameter and rotational speed of the printing rollers, the speed and direction of the advancing yarns will closely correspond to the peripheral speed and direction through the nip of the printing rollers.

The pattern control 80 serves to selectively operate the solenoids 76, 77 in accordance with a predetermined program, which is typically in a non-regular sequence in order to avoid a regular colorband pattern. Thus for example, when the solenoid 77 is activated, the lever arm 74 and guide 70 are shifted to the dashed line position as shown in FIG. 2. The yarn is thereby drawn into the nip of the printing rollers, with the rollers separating slightly against the resilient biasing force of the spring 49. When the solenoid 76 is activated (the solenoid 77 being concurrently released), the lever arm 74 and guide 70 are shifted back to the solid line position and the yarn is withdrawn from the nip. In this regard, the fact that the yarn is advancing at the same speed and direction as the rollers at the nip serves to facilitate the entry of the yarn into the nip.

The predetermined program is preferably designed to deflect the yarn into and out of the nips such that substantially all portions of the yarn enter at least one of the nips and thus have at least one of the dyes applied thereto. Further, the speed of the deflection is sufficiently rapid (typically about 2 milliseconds) to insure that the colorbands may be juxtaposed without significant ovelap and with a sharp break at the interface between the colorbands. Alternatively, the pattern control may, if desired, be programmed to obtain an overlap between the individually applied colorbands, to thereby achieve a further variation in the pattern and colors applied. In any event, the pattern control system of the present invention is adapted to apply the several colorbands in a predetermined, non-regular sequence which is designed to avoid visible streaks or chevrons on the face of the fabric produced from the yarns.

In one particular example, the spring 49 of each pair of printing rollers exerts a downward force of about 15 pounds, and with the leverage provided by the lever arm 48, the spring serves to exert a force of about 30 pounds across the nip. The rollers 44, 45 have a diameter of 1½ inches and a width of ½ inch, and they are rotated at a speed of about 3050 rpm to achieve a peripheral speed of about 400 yards per minute. Under these conditions, it takes only about 0.4 milliseconds for a particular yarn segment to pass linearly through the nip, and since the rise in compressive force on the yarn takes place in the first half of the nip, the rise in compressive takes place in only about 0.2 milliseconds. Thus, each yarn segment is subjected to a significant hammerlike "impact" upon passing through the nip, which serves to force the associated dye deeply into the body of the yarn and thereby assure complete penetration thereof.

In the above example, it has been found that colorband lengths as short as 3 to 4 inches may be readily achieved with the present invention, even at speeds of 400 yards per minute. As will be apparent, there is no upper limit to the colorband lengths since the yarn may be held in any particular nip for any desired period of time. Also, by selectively programing the operation of the various solenoids, it is possible to juxtapose the various colorbands without significant overlap and with a clear break therebetween.

In the illustrated embodiment two yarn ends may be brought together as illustrated schematically in FIG. 1 and passed simultaneously along each of the four paths of travel to thereby achieve a simultaneous processing of eight yarn ends. Typically, each of the yarns ends comprises 1800 denier, two ply nylon, and it will be understood that where different yarn constructions are employed, the number of ends which may be simultaneously processed along each of the four paths of travel may be increased or necessarily decreased. In this regard, the above nylon yarn has a diameter of between about 0.010 and 0.015 inches when squeezed, which represents the separation of the rollers 44, 45 when the yarn is passed through the nip.

The viscosity of the dyes should be relatively low to facilitate penetration thereof into the yarn, and preferably, the dyes should have a viscosity closely approaching that of water. If a gum is used in the dye, its amount preferably should not be greater than about 0.1% by weight since a greater amount may hinder the penetration of the dye into the yarn.

FIGS. 8–11 illustrate an alternate embodiment of the printing rollers. In this instance, the rollers 90, 91 are mounted so as to be spaced apart at the nip by a distance represented at 93, and which typically is about 0.001 inches. Both of the rollers 90, 91 have a knurled, stainless steel peripheral surface, and they are both positively driven at a corresponding rotational speed by the shaft 38 and gears 95, 96. In addition, the upper roller 91 is carried by the pivotal arm 98, and the arm 98 is resiliently biased downwardly by means of a pneumatic cylinder 99. The pneumatic cylinder 99 includes a piston 100 and connecting rod 101 pivotally attached at the free end of the arm 99, and a spring 102 is positioned beneath the piston. A threaded member 104 is threadedly connected to the arm adjacent the connecting rod 101, and extends downwardly through the arm and contacts the upper wall of the module. Thus the threaded member 104 acts as an adjustable stop, such that by rotating the threaded member the gap spacing 93 may be selectively varied and controlled. A lock nut 105 is provided to preclude inadvertent rotation of the threaded member 104.

During operation of the rollers shown in FIGS. 8–11, pressurized air is introduced into the pneumatic cylinder 99 above the piston 100 to bias the arm 98 downwardly and such that the threaded member 104 maintains the desired gap spacing. When the advancing yarn is deflected into the nip, the rollers 90, 91 separate slightly against the resilient force of the pneumatic cylinder 99. In this regard, the diameter of the yarn is substantially more than the gap, such that the yarn is subjected to substantially the same degree of "impact" compression in the nip as in the embodiment of FIGS. 2–7, and thus substantially the same degree of dye penetration into the yarn is achieved. However, since the rollers 90, 91 are not in rolling contact, wear of the surfaces is substantially eliminated. Further, the spacing of the rollers 90, 91 somewhat facilitates the entry of the yarn into the nip.

As a further, alternative embodiment of the present invention, the advancing rollers 61, 62 may be constructed to continuously apply an initial dye to the advancing yarns, such that the advancing rollers serve the dual function of advancing the yarn as well as continuously dyeing the same. The dyes intermittently applied at the downstream printing stations would thus be overdyed upon the initial dye applied by the advancing rollers. In this instance (which is not illustrated), the advancing rollers 61, 62 would be mounted within a module similar to those of the printing rollers, and each pair would include a dye applicator tube 54 and splash guard 59 as described above As still another possible variant of the present invention (not illustrated), the printing rollers may have lands and grooves about their peripheries to provide a gear-like appearance, and with the lands of the two rollers being aligned across the nip so that there is no meshing. Thus when the yarn is deflected into the nip, that portion of the yarn which passes through the nip will be intermittently printed to achieve closely spaced hash marks or dots along the yarn and thus further vary the dye pattern applied to the yarn.

One further aspect of the present invention resides in the fact that the amount of dye pick-up may be considerably reduced with the present invention as compared to conventional space dyeing processes. For example, it has been found that the present invention may be practiced with a dye pick-up of between only about 20 to 50% (based upon a comparison of the wet weight of the yarn after leaving the printer and the initial dry weight), while conventional space dyeing processes have a pick-up of 100% or more. This not only results in a reduction in the amount of dye utilized, but also substantially alleviates the problem of dye migration which is believed to result from excess dye being positioned between the filaments of the yarns during the dyeing process. With the present invention, very little if any excess dye is applied to the yarn, and very short colorband lengths, such as the above described hash marks or dots, may therefore be applied to the yarn without migration of the dye.

While the illustrated embodiment of the present invention includes three serially arranged printing stations, it will be appreciated that additional stations may be added to increase the number of colors which may be applied to each yarn.

In the drawings and specification, there has been set forth a preferred embodiment of the invention, and although specific terms are employed, they are used in a generic and descriptive sense only and not for purposes of limitation.

That which is claimed is:

1. A method of applying dye to spaced apart portions of a yarn to provide a patterned color effect and characterized by high production and substantially complete penetration of the dye into the yarn, and comprising the steps of advancing a yarn along a path of travel which is laterally spaced from the nip of a pair of operatively rotating applicator rollers, while supplying a dye to the peripheral surface of at least one of the applicator rollers, and while intermittently deflecting the advancing yarn into and out of the nip of the applicator rollers, such that those portions of the yarn which pass through the nip are subjected to a rapidly applied compressive force in the nip to cause the dye carried by the rollers to deeply penetrate into the yarn.

2. The method as defined in claim 1 wherein the peripheral speed of the rotating dye applicator rollers and their direction of rotation through the nip closely correspond to the speed and direction of the advancing yarn.

3. The method as defined in claim 2 comprising the further step of resiliently biasing the dye applicator rollers toward end other such that the rollers may slightly separate against the resistance of the biasing force to facilitate the entry of the advancing yarn into the nip.

4. The method as defined in claim 1 comprising the further step of wiping the advancing yarn immediately downstream of the nip to thereby remove any excess dye from the yarn.

5. The method as defined in claim 1 wherein the step of intermittently deflecting the yarn includes deflecting the yarn into and out of the nip in a predetermined, non-regular sequence.

6. A method of space dyeing yarn to provide a patterned color effect and characterized by high production and substantially complete penetration of the dye into the yarn, and comprising the steps of operatively rotating a pair of closely adjacent, dye applicator rollers while supplying a dye to the surface of at least one of the rollers and while resiliently biasing the rollers toward each other to permit the rollers to slightly separate against the resistance of the resilient biasing force, advancing a yarn along a path of travel which is laterally spaced from the nip of the rollers, and with the speed and direction of the advancing yarn closely corresponding to the peripheral speed and direction through the nip of the rollers, and while intermittently deflecting the advancing yarn into and out of the nip of the rollers in a predetermined sequence, such that those portions of the yarn which pass through the nip are subjected to a rapidly applied and substantial compressive force in the nip to cause the dye carried by the rollers to deeply penetrate into the yarn.

7. The method as defined in claim 6 wherein the rollers are rotated at a peripheral speed of at least about 400 yards per minute and the yarn is advanced at a closely corresponding speed.

8. The method as defined in claim 7 comprising the further steps of bringing together at least two yarn ends prior to advancing the same past the dye applicator rollers and such that the advancing yarn comprises a plurality of yarn ends which are concurrently advanced along the path of travel and intermittently deflected into and out of the nip, and then separating the yarn ends after the same have been dyed by the applicator rollers.

9. A method as defined in claim 7 comprising the further step of heat setting and bulking the yarn prior to advancing the same past the dye applicator rollers.

10. A method as defined in claim 7 comprising the further subsequent step of steaming the dyed yarn to set the dye thereon.

11. The method as defined in claim 10 comprising the further step of washing the yarn with an aqueous solution subsequent to the steaming step to remove any excess dye from the yarn.

12. A method as defined in claim 11 comprising the further steps of drying the yarn subsequent to the washing step, and then winding the yarn into a package.

13. A method of applying dyes of differing colors to spaced apart portions of a yarn to provide a patterned multi-color effect, and characterized by high production and substantially complete penetration of the dyes into the yarn, and comprising the steps of advancing a yarn along a path of travel which is laterally spaced from the nip of each of a plurality of pairs of closely adjacent, operatively rotating dye applicator rollers, while supplying a dye to the peripheral surface of at least one of each of the pairs of rollers, with the color of the dye supplied to each of the pairs being different from the color supplied to the other pairs, and while intermittently deflecting the advancing yarn into and out of the nips of the pairs of rollers in accordance with a predetermined program and such that those portions of the yarn which are deflected into any of the nips are subjected to a rapidly applied and substantial compressive force in the nip to cause the associated dye to deeply penetrate into the yarn.

14. The method as defined in claim 13 wherein the step of intermittently deflecting the yarn includes deflecting the yarn in a predetermined sequence with respect to each of the nips such that substantially all portions of the yarn enter at least one of the nips and thus have at least one of the dyes applied thereto.

15. The method as defined in claim 13 wherein the step of intermittently deflecting the yarn includes deflecting the yarn in a predetermined sequence with respect to each of the nips such that substantially no portion of the advancing yarn enters more than one nip and thus there is substantially no overlap of the dyes on the yarn.

16. The method as defined in claim 13 comprising the further step of wiping the advancing yarn at a point downstream of each pair of rollers to thereby remove any excess dye applied by such pair of rollers.

* * * * *